US008845885B2

(12) United States Patent
Hassan et al.

(10) Patent No.: US 8,845,885 B2
(45) Date of Patent: Sep. 30, 2014

(54) CRUDE OIL DESULFURIZATION

(75) Inventors: Abbas Hassan, Sugar Land, TX (US); Aziz Hassan, Sugar Land, TX (US); Rayford G. Anthony, College Station, TX (US); Gregory G. Borsinger, Chatham, NJ (US)

(73) Assignee: H R D Corporation, Houston, TX (US)

( * ) Notice: Subject to any disclaimer, the term of this patent is extended or adjusted under 35 U.S.C. 154(b) by 117 days.

(21) Appl. No.: 13/196,519

(22) Filed: Aug. 2, 2011

(65) Prior Publication Data

US 2012/0111769 A1 May 10, 2012

Related U.S. Application Data

(60) Provisional application No. 61/372,013, filed on Aug. 9, 2010.

(51) Int. Cl.

| | |
|---|---|
| ***C10G 29/00*** | (2006.01) |
| ***C10G 29/02*** | (2006.01) |
| ***C10G 31/10*** | (2006.01) |
| ***C10G 45/02*** | (2006.01) |
| ***B01F 7/00*** | (2006.01) |
| ***B01F 13/10*** | (2006.01) |
| ***C10G 31/09*** | (2006.01) |
| ***C10G 19/02*** | (2006.01) |

(52) U.S. Cl.

CPC ..... *B01F 7/00766* (2013.01); *C10G 2300/308* (2013.01); *C10G 2300/205* (2013.01); *C10G 31/10* (2013.01); *B01F 13/1016* (2013.01); *C10G 2300/202* (2013.01); *C10G 31/09* (2013.01); *C10G 19/02* (2013.01)

USPC ..... 208/208 R; 208/177; 208/189; 208/207; 208/236

(58) Field of Classification Search

CPC . B01F 13/1016; B01F 7/00766; C10G 19/02; C10G 2300/202; C10G 2300/205; C10G 2300/308; C10G 31/09; C10G 31/10

USPC ..... 208/208 R, 209, 236, 207; 366/108, 366/124, 125

See application file for complete search history.

(56) References Cited

U.S. PATENT DOCUMENTS

| | | | |
|---|---|---|---|
| 1,942,054 | A | 3/1930 | Garrison |
| 1,954,119 | A | 10/1930 | Caldwell |

(Continued)

FOREIGN PATENT DOCUMENTS

| | | |
|---|---|---|
| CN | 101588864 | 11/2009 |
| EP | 752460 | 1/1997 |

(Continued)

OTHER PUBLICATIONS

Paul, E, et al., Handbook of Industrial Mixing: Science and Practice, 2004, Wiley, p. 502.*

(Continued)

*Primary Examiner* — Walter D Griffin
*Assistant Examiner* — Derek Mueller
(74) *Attorney, Agent, or Firm* — Timothy S. Westby; Porter Hedges, LLP.

(57) ABSTRACT

A method of removing sulfur from sour oil by subjecting sour oil having a first sulfur content to high shear in the presence of at least one desulfurizing agent to produce a high shear treated stream, wherein the at least one desulfurizing agent is selected from the group consisting of bases and inorganic salts, and separating both a sulfur-rich product and a sweetened oil product from the high shear-treated stream, wherein the sulfur-rich product comprises elemental sulfur and wherein the sweetened oil product has a second sulfur content that is less than the first sulfur content. A system for reducing the sulfur content of sour oil via at least one high shear device comprising at least one rotor and at least one complementarily-shaped stator, and at least one separation device configured to separate a sulfur-rich product and sweetened oil from the high shear-treated stream.

30 Claims, 3 Drawing Sheets

(56) References Cited

U.S. PATENT DOCUMENTS

| | | | | |
|---|---|---|---|---|
| 2,177,343 | A | 10/1939 | Hughes | |
| 2,321,290 | A | 6/1943 | Giraitis | |
| 2,322,544 | A | 6/1943 | Winding | |
| 2,349,543 | A | 5/1944 | Johnson | |
| 2,361,651 | A | 10/1944 | Proell et al. | |
| 2,481,300 | A | 9/1949 | Engel | |
| 2,772,211 | A | 11/1956 | Hawkes | |
| 3,294,678 | A | 12/1966 | Gleim | |
| 3,402,998 | A | 9/1968 | Squires | |
| 3,489,677 | A * | 1/1970 | Young et al. | 208/236 |
| 3,699,037 | A | 10/1972 | Annesser et al. | |
| 3,850,745 | A | 11/1974 | Ellender, Jr. | |
| 3,887,167 | A | 6/1975 | Irwin | |
| 4,003,824 | A | 1/1977 | Baird, Jr. et al. | |
| 5,538,191 | A | 7/1996 | Holl | |
| 5,877,350 | A | 3/1999 | Langer et al. | |
| 6,368,366 | B1 | 4/2002 | Langer et al. | |
| 6,368,367 | B1 | 4/2002 | Langer et al. | |
| 6,383,237 | B1 | 5/2002 | Langer et al. | |
| 6,530,964 | B2 | 3/2003 | Langer et al. | |
| 6,742,774 | B2 | 6/2004 | Holl | |
| 2003/0043690 | A1 | 3/2003 | Holl | |
| 2003/0051988 | A1 | 3/2003 | Gunnerman et al. | |
| 2004/0052158 | A1 | 3/2004 | Holl | |
| 2005/0033069 | A1 | 2/2005 | Holl et al. | |
| 2006/0245991 | A1 | 11/2006 | Holl et al. | |
| 2006/0254956 | A1 | 11/2006 | Khan | |
| 2007/0209967 | A1 | 9/2007 | Allinson et al. | |
| 2009/0000989 | A1 * | 1/2009 | Hassan et al. | 208/209 |
| 2009/0152168 | A1 * | 6/2009 | Siskin et al. | 208/229 |
| 2010/0004419 | A1 | 1/2010 | Hassan et al. | |

FOREIGN PATENT DOCUMENTS

| | | | |
|---|---|---|---|
| JP | 48008303 | | 3/1973 |
| JP | 48055202 | | 7/1973 |
| JP | 03157490 | | 7/1991 |
| JP | 2007502892 | | 2/2007 |
| JP | 2010520367 | | 6/2010 |
| WO | 02064708 | A2 | 8/2002 |
| WO | 2009-002960 | A1 | 12/2009 |

OTHER PUBLICATIONS

Wilhelm, S., et al., Mercury in Petroleum, Fuel Processing Technology, 2000, vol. 63, Elsevier, pp. 1-27.*

IKA, "Introduction to IKA's Three Stage Dispax Reactor," Retrieved from <http://www.ikausa.com/pdfs/process/dr%202000-Homogenizing-Dispersing-Suspending-Emulsifying.pdf> on Aug. 22, 2012 (12 pgs.).

IKA-DRS Reactors website http://www.ikausa.com/dr.him, on Sep. 8, 2010 (2 pgs.).

Office Action dated Jun. 25, 2009 for U.S. Appl. No. 12/142,447 (10 pgs.).

Office Action dated Jan. 7, 2010 for U.S. Appl. No. 12/142,447 (6 pgs.).

Office Action dated May 13, 2010 for U.S. Appl. No. 12/142,447 (5 pgs.).

Office Action dated Feb. 4, 2010 for U.S. Appl. No. 12/492,721 (5 pgs.).

Office Action dated Feb. 18, 2010 for U.S. Appl. No. 12/635,433 (6 pgs.).

Office Action dated Feb. 18, 2010 for U.S. Appl. No. 12/635,454 (6 pgs.).

Office Action dated May 14, 2010 for U.S. Appl. No. 12/137,441 (15 pgs.).

Office Action dated Feb. 19, 2010 for U.S. Appl. No. 12/144,459 (10 pgs.).

Office Action dated Sep. 2, 2009 for U.S. Appl. No. 12/142,433 (11 pgs.).

Office Action dated Jan. 29, 2010 for U.S. Appl. No. 12/142,433 (8 pgs.).

Office Action dated May 24, 2011 for U.S. Appl. No. 12/142,433 (10 pgs.).

Office Action dated Apr. 30, 2010 for U.S. Appl. No. 12/141,191 (12 pgs.).

Office Action dated Oct. 27, 2009 for U.S. Appl. No. 12/142,120 (15 pgs.).

Office Action dated May 5, 2010 for U.S. Appl. No. 12/571,537 (12 pgs.).

Office Action dated Feb. 24, 2011 for U.S. Appl. No. 12/796,358 (13 pgs.).

Office Action dated Feb. 29, 2012 for U.S. Appl. No. 12/146,733 (8 pgs.).

Office Action dated Jun. 3, 2011 for U.S. Appl. No. 12/568,155 (11 pgs.).

Office Action dated Jun. 2, 2011 for U.S. Appl. No. 12/427,286 (12 pgs.).

Office Action dated Jun. 3, 2011 for U.S. Appl. No. 12/568,280 (16 pgs.).

International Preliminary Report on Patentability dated Feb. 21, 2013 for corresponding International Application No. PCT/US2011/046476 (8 pgs.).

Gogate et al., "Cavitation: A technology on the horizon," Current Science 91 (No. 1): 35-46 (2006).

IKA—Rotor-Stator Generators—2003 Processing Catalog (38 pgs.).

International Search Report dated Mar. 21, 2012 for corresponding International Application No. PCT/US2011/04676 (12 pgs.).

Gegate et al., "Cavitation: A technology on the horizon," Current Science 91 (No. 1): 35-46 (2006).

Chinese Office Action dated Mar. 4, 2014 for corresponding Chinese Application No. 201180039165.4 (24 pgs.).

Japanese Office Action dated Mar. 4, 2014 for corresponding Japanese Application No. 2013524109 (3 pgs.).

Korean Office Action dated Feb. 26, 2014 for corresponding Korean Application No. 10-2013-7002196 (9 pgs.) .

European Search Report dated May 27, 2014 for corresponding European Application No. 11816830.1-1361 (7 pgs.).

Japanese Office Action dated Mar. 4, 2014 for corresponding Japanese Application No. 2013524109 (6 pgs.).

Canadian Office Action dated Apr. 1, 2014 for corresponding Canadian Application No. 2,807,632 (2 pgs.).

* cited by examiner

CRUDE OIL DESULFURIZATION

CROSS-REFERENCE TO RELATED APPLICATIONS

This application claims the benefit under 35 U.S.C. §119 (e) of U.S. Provisional Patent Application No. 61/372,013 filed Aug. 9, 2010, the disclosure of which is hereby incorporated herein by reference.

STATEMENT REGARDING FEDERALLY SPONSORED RESEARCH OR DEVELOPMENT

Not Applicable.

BACKGROUND

1. Technical Field

The present invention relates generally to the removal of sulfur from oil. More particularly, the present invention relates to a system and method for sweetening crude oil. Still more particularly, the present invention relates to a system and method for removal of sulfur from oil via high shear.

2. Background of the Invention

Crude oil is generally associated with significant quantities of hydrogen sulfide and contains various other organic and inorganic sulfur compounds. Natural fossil fuels, such as crude oil and natural gas, that contain a substantial concentration of sulfur compounds, such as hydrogen sulfide, sulfur dioxide, and mercaptans, are referred to as 'sour.' Sulfur compounds may evolve from fossil fuels over time and the evolution of these compounds produces significant environmental and safety issues. Emissions of various sulfur compounds, including hydrogen sulfide and sulfur dioxide are regulated. Due to enhanced regulations and restrictions, it is desirable to remove sulfur compounds from crude oil.

There is an ever-increasing shortage of naturally-occurring low sulfur crude oil. With the increasing emphasis on pollution control and the resulting demand for low sulfur content petroleum crude oil, a need for the economical production of sulfur-reduced crude has arisen.

Besides meeting enhanced regulations and restrictions, removal of sulfur from crude oil is desirable for other reasons. Not only does the evolution of sulfur compounds from crude oil produce significant environmental and safety issues, these compounds may also attack metal components of the oil well, as well as pipelines and storage tanks and downstream refinery apparatus. This attack causes corrosion and/or brittleness of the metal components. Additionally, in a refinery, downstream processes may utilize catalysts which are sensitive to the presence of sulfur.

In conventional oil refineries, sulfur is generally removed after the crude oil has been fractionated. Sulfur removal typically comprises utilization of various desulfurization processes, often requiring extreme operating conditions, and incorporation of expensive equipment, often associated with high maintenance costs. Examples of prior art processes for conventional sulfur removal can be found in U.S. Pat. Nos. 1,942,054; 1,954,116; 2,177,343; 2,321,290; 2,322,554; 2,348,543; 2,361,651; 2,481,300; 2,772,211; 3,294,678; 3,402,998; 3,699,037; and 3,850,745, the disclosure of each of which is hereby incorporated herein in its entirety for all purposes not contrary to this disclosure.

Accordingly, there is a need in industry for systems and processes of removing sulfur from crude oil. Desirably, the system and method allow sweetening of crude oil proximal the removal of the oil from the earth. The system and method may also be utilized to enhance the API gravity of the crude oil and/or for removal of other impurities, such as heavy metals, from the crude oil.

SUMMARY

Herein disclosed is a method of removing sulfur from sour oil, the method comprising (a) subjecting sour oil having a first sulfur content to high shear in the presence of at least one desulfurizing agent to produce a high shear treated stream, wherein the at least one desulfurizing agent is selected from the group consisting of bases and inorganic salts; and (b) separating both a sulfur-rich product and a sweetened oil product from the high shear-treated stream, wherein the sulfur-rich product comprises elemental sulfur and wherein the sweetened oil product has a second sulfur content that is less than the first sulfur content. In embodiments, subjecting the sour oil to high shear in the presence of the at least one desulfurizing agent (a) comprises subjecting the slurry to a shear rate of at least 10,000 $s^{-1}$. In embodiments, subjecting the sour oil to high shear in the presence of the at least one desulfurizing agent (a) comprises subjecting the slurry to a shear rate of at least 20,000 $s^{-1}$. In embodiments, at least one desulfurizing agent is selected from the group consisting of aqueous ammonia, sodium hydroxide, potassium hydroxide, ammonium sulfate, calcium carbonate, hydrogen, hydrogen peroxide, monoethanolamine (MEA), diglycolamine (DGA), diethanolamine (DEA), diisopropanolamine (DIPA) and methyldiethanolamine (MDEA). In embodiments, at least one desulfurizing agent is selected from the group consisting of ammonium sulfate and ammonium hydroxide.

In embodiments, the sour oil and the at least one desulfurizing agent are provided in a ratio of about 50:50 volume percent. In embodiments, the first sulfur content is in the range of from about 0.5 to 6 weight percent. In embodiments, the second sulfur content is less than 50% of the first sulfur content. In embodiments, the second sulfur content is less than 10% of the first sulfur content. In embodiments, the second sulfur content is less than 0.5 weight percent. In embodiments, subjecting sour oil to high shear (a) comprises introducing the sour oil and the at least one desulfurizing agent into a high shear device comprising at least one rotor and at least one complementarily-shaped stator. High shear can comprise a shear rate of at least 10,000 $s^{-1}$, wherein the shear rate is defined as the tip speed divided by the shear gap, and wherein the tip speed is defined as $\pi Dn$, where D is the diameter of the at least one rotor and n is the frequency of revolution. In embodiments, high shear comprises a shear rate of at least 20,000 $s^{-1}$, wherein the shear rate is defined as the tip speed divided by the shear gap, and wherein the tip speed is defined as $\pi Dn$, where D is the diameter of the at least one rotor and n is the frequency of revolution.

In embodiments, subjecting the sour oil to a shear rate of at least 10,000 $s^{-1}$ produces a local pressure of at least about 1034.2 MPa (150,000 psi) at a tip of the at least one rotor. In embodiments, (a) comprises providing a tip speed of the at least one rotor of at least about 23 m/sec, wherein the tip speed is defined as $\pi Dn$, where D is the diameter of the at least one rotor and n is the frequency of revolution. In embodiments, the shear gap, which is the minimum distance between the at least one rotor and the at least one complementarily-shaped stator, is less than about 5 μm.

In embodiments, (a) comprises subjecting sour oil to high shear in the presence of at least one desulfurizing agent and an API-adjustment gas, wherein the API adjustment gas comprises at least one compound selected from the group consisting of hydrogen, carbon monoxide, carbon dioxide, methane and ethane. In embodiments, the sour oil has a first API gravity, the sweetened oil product has a second API gravity, and the second API gravity is greater than the first API gravity. In embodiments, the API-adjustment gas is selected from the group consisting of associated gas, unassociated gas, FCC offgas, coker offgas, pyrolysis gas, hydrodesulfurization offgas, catalytic cracker offgas, thermal cracker offgas, and combinations thereof. In embodiments, the high shear-treated stream comprises API-adjustment gas bubbles having an average diameter of less than or equal to about 5, 4, 3, 2 or 1 μm. In embodiments, the API-adjustment gas bubbles have an average diameter of less than or equal to about 100 nm.

In embodiments, the sour oil has a first API gravity, the sweetened oil has a second API gravity, and the second API gravity is greater than the first API gravity. The sour oil can be extracted from the earth at a location proximal the location at which the method is carried out. In embodiments, the sulfur-rich product is yellow.

In embodiments, remaining after (b) (separating a sulfur-rich product and a sweetened oil product from the high shear-treated stream) is a remaining stream comprising at least one desulfurizing agent, and the method further comprises (c) recycling at least a portion of the at least one desulfurizing agent in the remaining stream to (a). In embodiments, aqueous ammonia is utilized in (a) during startup, ammonium sulfate is produced in (a), separated in (b) and recycled in (c) to (a) as desulfurizing agent, and aqueous ammonia is introduced in (a) only as needed to maintain a desired second sulfur content.

In embodiments, the sour oil further comprises at least one impurity selected from the group consisting of heavy metals and chlorides. In embodiments, at least one of the at least one impurities is separated from the high shear-treated stream with the sulfur-rich product. In embodiments, the at least impurity is selected from the group consisting of vanadium, mercury and chlorides.

In embodiments, the sulfur-rich product is separated as a substantially dry product. In embodiments, separating at (b) comprises centrifugation, filtration or a combination thereof.

Also disclosed herein is a system for reducing the sulfur content of sour oil, the system comprising: at least one high shear device comprising at least one rotor and at least one complementarily-shaped stator, and configured to subject the sour oil to high shear and produce a high shear-treated stream comprising sweetened oil, wherein the at least one high shear device is configured to subject the contents therein to a shear rate of at least 10,000 $s^{-1}$, wherein the shear rate is defined as the tip speed divided by the shear gap, and wherein the tip speed is defined as $\pi Dn$, where D is the diameter of the at least one rotor and n is the frequency of revolution; and at least one separation device configured to separate a sulfur-rich product and sweetened oil from the high shear-treated stream.

In embodiments, the at least one rotor is configured to provide a tip speed of at least about 23 m/sec. In embodiments, the at least one rotor is configured to provide a tip speed of at least 40 m/sec. In embodiments, the at least one rotor is separated from the at least one stator by a shear gap of less than about 5 μm, wherein the shear gap is the minimum distance between the at least one rotor and the at least one stator. In embodiments, the shear rate provided by rotation of the at least one rotor during operation is at least 20,000 $s^{-1}$.

The system can further comprise one or more lines for introducing at least one desulfurizing agent selected from the group consisting of bases and inorganic salts, at least one API-adjustment gas comprising at least one component selected from the group consisting of carbon monoxide, carbon dioxide, hydrogen, methane and ethane, or one or more lines for introducing both desulfurizing agent and API-adjustment gas into the sour oil upstream of the at least one high shear device and/or directly into the at least one high shear device.

The system can further comprise a recycle line for recycling at least one desulfurizing agent from the at least one separation device to the at least one high shear device. In embodiments, the at least one separation device is configured to provide a substantially dry sulfur product. In embodiments, the at least one high shear device comprises at least two generators, wherein each generator comprises a rotor and a complementarily-shaped stator. The shear rate provided by one generator can be greater than the shear rate provided by another generator. The at least one separation device can be selected from the group consisting of centrifuges and filtration devices. In embodiments, the at least one separation device comprises a centrifuge.

In embodiments, the system is a closed-loop system. The system can be configured as a mobile unit, a modular unit, or both. In embodiments, the system comprises no device selected from the group consisting of heating apparatus, distillation apparatus, settling tanks and combinations thereof.

Certain embodiments of the above-described methods or systems potentially provide overall cost reduction by providing for reduced catalyst/desulfurizing agent usage, permitting increased fluid throughput, permitting operation at lower temperature and/or pressure, and/or reducing capital and/or operating costs. These and other embodiments and potential advantages will be apparent in the following detailed description and drawings.

BRIEF DESCRIPTION OF THE DRAWINGS

For a more detailed description of the preferred embodiment of the present invention, reference will now be made to the accompanying drawings, wherein.

NOTATION AND NOMENCLATURE

Figure 1:
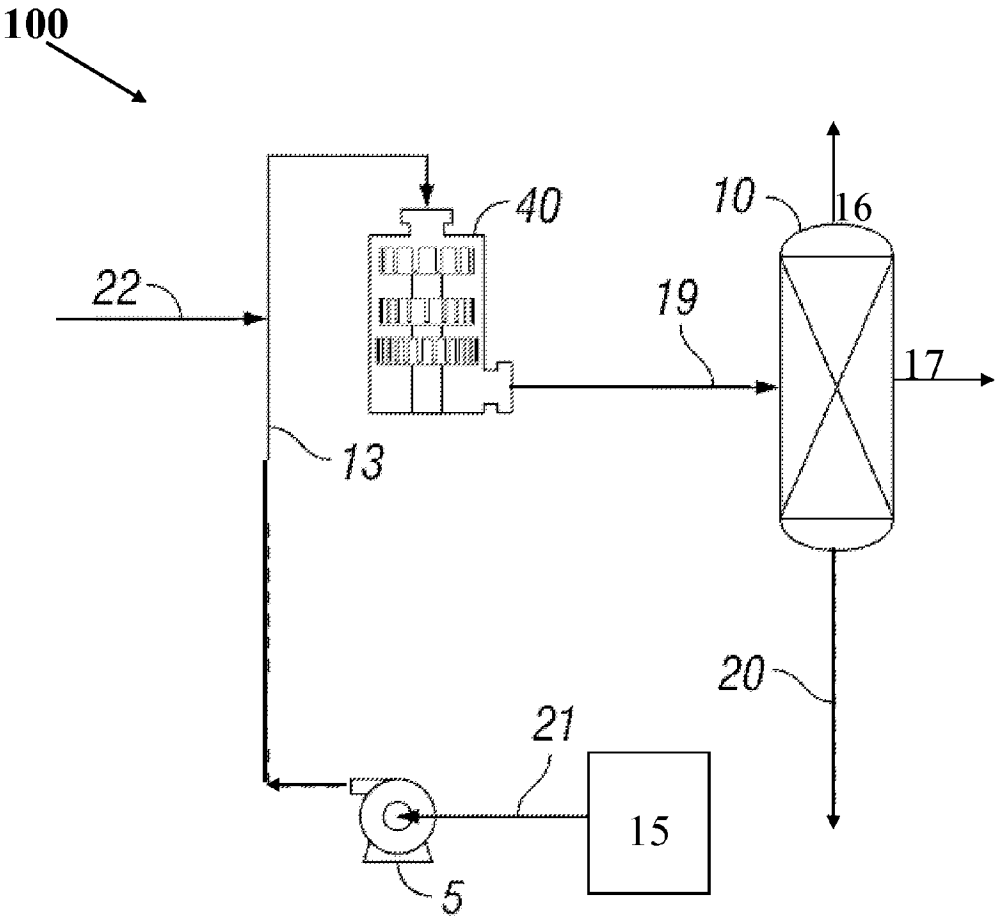
FIG. 1 is a schematic of a high shear system comprising an external high shear mixer/disperser according to an embodiment of the present disclosure.

As used herein, the term 'dispersion' refers to a liquefied mixture that contains at least two distinguishable substances (or 'phases') that will not readily mix and dissolve together. As used herein, a 'dispersion' comprises a 'continuous' phase (or 'matrix'), which holds therein discontinuous droplets, bubbles, and/or particles of the other phase or substance. The term dispersion may thus refer to foams comprising gas bubbles suspended in a liquid continuous phase, emulsions in which droplets of a first liquid are dispersed throughout a continuous phase comprising a second liquid with which the first liquid is immiscible, and continuous liquid phases throughout which solid particles are distributed. As used herein, the term 'dispersion' encompasses continuous liquid phases throughout which gas bubbles are distributed, continuous liquid phases throughout which solid particles (e.g., solid sulfur or catalyst) are distributed, continuous phases of a first liquid throughout which droplets of a second liquid that is substantially insoluble in the continuous phase are distributed, and liquid phases throughout which any one or a combination of solid particles, immiscible liquid droplets, and gas bubbles is distributed. Hence, a dispersion can exist as a homogeneous mixture in some cases (e.g., liquid/liquid phase), or as a heterogeneous mixture (e.g., gas/liquid, solid/liquid, or gas/solid/liquid), depending on the nature of the materials selected for combination. A dispersion may comprise, for example, bubbles of gas (e.g. API-adjustment gas) and/or droplets of one fluid (e.g., desulfurizing agent or oil) in a phase with which it is immiscible (e.g., oil or desulfurizing agent).

Use of the phrase, 'all or a portion of' is used herein to mean 'all or a percentage of the whole' or 'all or some components of.'

As used herein, for conciseness, the term "desulfurizing agent" is utilized to include pH enhancers, which are compounds that alter the pH of a solution when added thereto. That is, for brevity, the term "desulfurizing agent" refers herein to "desulfurizing agents and/or pH enhancers." As discussed further hereinbelow, the desulfurizing agent may be basic or acidic. In embodiments, the desulfurizing agent is a base. The desulfurizing agent may be caustic. In embodiments, the desulfurizing agent is selected from the group consisting of ammonia, sodium hydroxide, potassium hydroxide, ammonium sulfate, calcium carbonate, hydrogen, hydrogen peroxide, monoethanolamine (MEA), diglycolamine (DGA), diethanolamine (DEA), diisopropanolamine (DIPA) and methyldiethanolamine (MDEA). In embodiments, the desulfurizing agent is aqueous ammonia. In embodiments, the desulfurizing agent is 28% aqueous ammonia (28% $NH_4OH$). In embodiments, the desulfurizing agent comprises an inorganic salt. In embodiments, the desulfurizing agent comprises calcium carbonate. In embodiments, the desulfurizing agent comprises ammonium sulfate.

DETAILED DESCRIPTION

Overview.

Herein disclosed are a system and method for sweetening oil. The oil to be sweetened may be crude oil or an oil derived from crude oil. The system comprises an external high shear mechanical device to provide rapid contact and mixing of reactants in a controlled environment in the reactor/mixer device. Via the disclosed system and method, hydrogen sulfide and sulfur compounds in the oil can be removed as sulfur in dry (or substantially dry) form without producing undesirable emissions. The system and method may be utilized to remove sulfur from oil at the source (e.g., at a wellsite). Desirably, the system is fully modular and/or mobile and utilizable for sweetening sour crude oil proximal the source of the crude. In embodiments, the system is operable as a closed loop.

In embodiments, the system and method allow desulfurization of oil at substantially atmospheric global operating conditions. Reduction in sulfur content effected by the disclosed system and method may eliminate any need for further downstream desulfurization processes.

A reactor assembly that comprises an external high shear device (HSD) or mixer as described herein may decrease mass transfer limitations and thereby allow the reaction, which may be catalytic, to more closely approach kinetic limitations. Enhancing contact via the use of high shear may permit increased throughput and/or the use of a decreased amount of catalyst (e.g., ammonia/ammonium sulfate in certain embodiments) relative to conventional processes and/or may enable reactions to occur that would otherwise not be expected to occur.

High Shear System for Sweetening of Crude Oil.

A high shear system 100 for removal of sulfur from oil will now be described with reference to FIG. 1, which is a process flow diagram of a high shear system 100 according to an embodiment of this disclosure. The basic components of a representative system include external high shear device (HSD) 40 and separation unit(s) 10. Oil sweetening system 100 may further comprise pump 5 and/or oil source 15. Each of these components is further described in more detail below. Desulfurization system 100 may be configured as a modular and/or mobile unit (e.g., skid unit). Configuration as a modular/mobile unit may be useful for utilization at a wellhead, for example. Desulfurization system 100 may be designed for any desired volumetric flow rate, for example, 100, 250, 500, 900, 1500, 2000, 3000, 4000, or 5000 gpm or more, or any range encompassed therein.

Line 21 is connected to pump 5 for introducing feed comprising crude oil into pump 5. Line 13 connects pump 5 to HSD 40, and line 19 carries a high shear-treated stream out of HSD 40. Flow line 19 is any line into which the high shear-treated stream from HSD 40 (comprising sweetened oil) flows. Separation unit(s) 10 is fluidly connected to HSD 40, for example via high shear-treated product flow line 19. Separation unit(s) 10 may comprise one or more outlets. For example, in the embodiment of FIG. 1, separation unit(s) 10 comprises first separator outlet 16, second separator outlet 17, and third separator outlet 20.

Additional components or process steps can be incorporated between HSD 40 and separation unit(s) 10 or ahead of pump 5 or HSD 40, if desired, as will become apparent upon reading the description of the high shear process hereinbelow. For example, line 17 can be connected to line 21, line 22 or line 13, such that material (e.g. pH enhancing and/or desulfurizing material) from separation unit(s) 10 may be recycled to HSD 40. Sweetened crude oil may be removed from system 100 via, for example, first separator outlet 16.

In embodiments, one or more lines 22 are configured to introduce desulfurizing agent reactant (e.g. ammonia) and/or API-adjustment gas into HSD 40. Line(s) 22 may introduce fresh reactant into HSD 40 directly or may introduce reactant into line 13.

High Shear Device 40.

High shear oil desulfurization system 100 comprises one or more high shear devices 40. External high shear device (HSD) 40, also sometimes referred to as a high shear mixer, is configured for receiving an inlet stream, via line 13. Line(s) 22 may be configured to introduce desulfurizing agent (e.g. fresh or recycled from separation unit(s) 10) and/or API-adjustment gas into HSD 40. Alternatively, HSD 40 may be configured for receiving desulfurizing agent and crude oil via separate inlet lines. Although only one HSD is shown for sweetening crude oil in the embodiment of FIG. 1, it should be understood that some embodiments of the system can comprise two or more HSDs. The two or more HSDs can be arranged in either series or parallel flow. In embodiments, crude oil sweetening system 100 comprises a single HSD 40.

HSD 40 is a mechanical device that utilizes one or more generators comprising a rotor/stator combination, each of which has a gap between the stator and rotor. The gap between the rotor and the stator in each generator set may be fixed or may be adjustable. HSD 40 is configured in such a way that it is capable of effectively contacting the components therein at rotational velocity. The HSD comprises an enclosure or housing so that the pressure and temperature of the fluid therein may be controlled.

High shear mixing devices are generally divided into three general classes, based upon their ability to mix fluids. Mixing is the process of reducing the size of particles or inhomogeneous species within the fluid. One metric for the degree or thoroughness of mixing is the energy density per unit volume that the mixing device generates to disrupt the fluid particles. The classes are distinguished based on delivered energy densities. Three classes of industrial mixers having sufficient energy density to consistently produce mixtures or emulsions with particle sizes in the range of submicron to 50 microns include homogenization valve systems, colloid mills and high speed mixers. In the first class of high energy devices, referred to as homogenization valve systems, fluid to be processed is pumped under very high pressure through a narrow-gap valve into a lower pressure environment. The pressure gradients across the valve and the resulting turbulence and cavitation act to break-up any particles in the fluid. These valve systems are most commonly used in milk homogenization and can yield average particle sizes in the submicron to about 1 micron range.

At the opposite end of the energy density spectrum is the third class of devices referred to as low energy devices. These systems usually have paddles or fluid rotors that turn at high speed in a reservoir of fluid to be processed, which in many of the more common applications is a food product. These low energy systems are customarily used when average particle sizes of greater than 20 microns are acceptable in the processed fluid.

Between the low energy devices and homogenization valve systems, in terms of the mixing energy density delivered to the fluid, are colloid mills and other high speed rotor-stator devices, which are classified as intermediate energy devices. A typical colloid mill configuration includes a conical or disk rotor that is separated from a complementary, liquid-cooled stator by a closely-controlled rotor-stator gap, which is commonly between 0.025 mm to 10 mm (0.001-0.40 inch). Rotors are usually driven by an electric motor through a direct drive or belt mechanism. As the rotor rotates at high rates, it pumps fluid between the outer surface of the rotor and the inner surface of the stator, and shear forces generated in the gap process the fluid. Many colloid mills with proper adjustment achieve average particle sizes of 0.1 to 25 microns in the processed fluid. These capabilities render colloid mills appropriate for a variety of applications including colloid and oil/water-based emulsion processing such as that required for cosmetics, mayonnaise, or silicone/silver amalgam formation, to roofing-tar mixing.

The HSD comprises at least one revolving element that creates the mechanical force applied to the reactants therein. The HSD comprises at least one stator and at least one rotor separated by a clearance. For example, the rotors can be conical or disk shaped and can be separated from a complementarily-shaped stator. In embodiments, both the rotor and stator comprise a plurality of circumferentially-spaced rings having complementarily-shaped tips. A ring may comprise a solitary surface or tip encircling the rotor or the stator. In embodiments, both the rotor and stator comprise more than 2 circumferentially-spaced rings, more than 3 rings, or more than 4 rings. For example, in embodiments, each of three generators comprises a rotor and stator each having 3 complementary rings, whereby the material processed passes through 9 shear gaps or stages upon traversing HSD 40. Alternatively, each of three generators may comprise four rings, whereby the processed material passes through 12 shear gaps or stages upon passing through HSD 40. In some embodiments, the stator(s) are adjustable to obtain the desired shear gap between the rotor and the stator of each generator (rotor/stator set). Each generator may be driven by any suitable drive system configured for providing the desired rotation.

In some embodiments, HSD 40 comprises a single stage dispersing chamber (i.e., a single rotor/stator combination; a single high shear generator). In some embodiments, HSD 40 is a multiple stage inline disperser and comprises a plurality of generators. In certain embodiments, HSD 40 comprises at least two generators. In other embodiments, HSD 40 comprises at least 3 generators. In some embodiments, HSD 40 is a multistage mixer whereby the shear rate (which varies proportionately with tip speed and inversely with rotor/stator gap width) varies with longitudinal position along the flow pathway, as further described hereinbelow.

According to this disclosure, at least one surface within HSD 40 may be made of, impregnated with, or coated with a catalyst suitable for catalyzing a desired reaction, as described in U.S. patent application Ser. No. 12/476,415, which is hereby incorporated herein by reference for all purposes not contrary to this disclosure. For example, in embodiments, all or a portion of at least one rotor, at least one stator, or at least one rotor/stator set (i.e., at least one generator) is made of, coated with, or impregnated with a suitable catalyst. In some applications, it may be desirable to utilize two or more different catalysts. In such instances, a generator may comprise a rotor made of, impregnated with, or coated with a first catalyst material, and the corresponding stator of the generator may be made of, coated with, or impregnated by a second catalyst material. Alternatively one or more rings of the rotor may be made from, coated with, or impregnated with a first catalyst, and one or more rings of the rotor may be made from, coated with, or impregnated by a second catalyst. Alternatively one or more rings of the stator may be made from, coated with, or impregnated with a first catalyst, and one or more rings of the stator may be made from, coated with, or impregnated by a second catalyst. All or a portion of a contact surface of a stator, rotor, or both can be made from or coated with catalytic material.

A contact surface of HSD 40 can be made from a porous sintered catalyst material, such as platinum. In embodiments, a contact surface is coated with a porous sintered catalytic material. In applications, a contact surface of HSD 40 is coated with or made from a sintered material and subsequently impregnated with a desired catalyst. The sintered material can be a ceramic or can be made from metal powder, such as, for example, stainless steel or pseudoboehmite. The pores of the sintered material may be in the micron or the submicron range. The pore size can be selected such that the desired flow and catalytic effect are obtained. Smaller pore size may permit improved contact between fluid comprising reactants and catalyst. By altering the pore size of the porous material (ceramic or sintered metal), the available surface area of the catalyst can be adjusted to a desired value. The sintered material may comprise, for example, from about 70% by volume to about 99% by volume of the sintered material or from about 80% by volume to about 90% by volume of the sintered material, with the balance of the volume occupied by the pores.

In embodiments, the rings defined by the tips of the rotor/stator contain no openings (i.e. teeth or grooves) such that substantially all of the reactants are forced through the pores of the sintered material, rather than being able to bypass the catalyst by passing through any openings or grooves which are generally present in conventional dispersers. In this manner, for example, a reactant will be forced through the sintered material, thus forcing contact with the catalyst.

In embodiments, the sintered material of which the contact surface is made comprises stainless steel or bronze. The sintered material (sintered metal or ceramic) may be passivated. A catalyst may then be applied thereto. The catalyst may be applied by any means known in the art. The contact surface may then be calcined to yield the metal oxide (e.g. stainless steel). The first metal oxide (e.g., the stainless steel oxide) may be coated with a second metal and calcined again. For example, stainless steel oxide may be coated with aluminum and calcined to produce aluminum oxide. Subsequent treatment may provide another material. For example, the aluminum oxide may be coated with silicon and calcined to provide silica. Several calcining/coating steps may be utilized to provide the desired contact surface and catalyst(s). In this manner, the sintered material which either makes up the contact surface or coats the contact surface may be impregnated with a variety of catalysts. Another coating technique, for example, is metal vapor deposition or chemical vapor deposition, such as typically used for coating silicon wafers with metal.

In some embodiments, the minimum clearance (shear gap width) between the stator and the rotor is in the range of from about 0.025 mm (0.001 inch) to about 3 mm (0.125 inch). The shear gap may be in the range of from about 5 micrometers (0.0002 inch) and about 4 mm (0.016 inch). In embodiments, the shear gap is in the range of 5, 4, 3, 2 or 1 μm. In some embodiments, the minimum clearance (shear gap width) between the stator and the rotor is in the range of from about 1 μm (0.00004 inch) to about 3 mm (0.012 inch). In some embodiments, the minimum clearance (shear gap width) between the stator and the rotor is less than about 10 μm (0.0004 inch), less than about 50 μm (0.002 inch), less than about 100 μm (0.004 inch), less than about 200 μm (0.008 inch), less than about 400 μm (0.016 inch). In certain embodiments, the minimum clearance (shear gap width) between the stator and rotor is about 1.5 mm (0.06 inch). In certain embodiments, the minimum clearance (shear gap width) between the stator and rotor is about 0.2 mm (0.008 inch). In certain configurations, the minimum clearance (shear gap) between the rotor and stator is at least 1.7 mm (0.07 inch). The shear rate produced by the HSD may vary with longitudinal position along the flow pathway. In some embodiments, the rotor is set to rotate at a speed commensurate with the diameter of the rotor and the desired tip speed. In some embodiments, the HSD has a fixed clearance (shear gap width) between the stator and rotor. Alternatively, the HSD has adjustable clearance (shear gap width).

Tip speed is the circumferential distance traveled by the tip of the rotor per unit of time. Tip speed is thus a function of the rotor diameter and the rotational frequency. Tip speed (in meters per minute, for example) may be calculated by multiplying the circumferential distance transcribed by the rotor tip, $2\pi R$, where R is the radius of the rotor (meters, for example) times the frequency of revolution (for example revolutions per minute, rpm). The frequency of revolution may be greater than 250 rpm, greater than 500 rpm, greater than 1000 rpm, greater than 5000 rpm, greater than 7500 rpm, greater than 10,000 rpm, greater than 13,000 rpm, or greater than 15,000 rpm. The rotational frequency, flow rate, and temperature may be adjusted to get a desired product profile. If channeling should occur, and sulfur removal is inadequate, the rotational frequency may be increased to minimize undesirable channeling. Alternatively or additionally, high shear-treated materials from a first HSD may be introduced into a second or subsequent HSD 40.

HSD 40 may provide a tip speed in excess of 22.9 m/s (4500 ft/min) and may exceed 40 m/s (7900 ft/min), 50 m/s (9800 ft/min), 100 m/s (19,600 ft/min), 150 m/s (29,500 ft/min), 200 m/s (39,300 ft/min), or even 225 m/s (44,300 ft/min) or greater in certain applications. In embodiments, the tip speed is in the range of from about 5.1 m/s, 23 m/s or 50 m/s to about 23 m/s, 50 m/s, 100 m/s, 150 m/s 200 m/s or 225 m/s, or any range therein (for example, from about 50 m/s to about 225 m/s). For the purpose of this disclosure, the term 'high shear' refers to mechanical rotor stator devices (e.g., colloid mills or rotor-stator dispersers) that are capable of tip speeds in excess of 5.1 m/s (1000 ft/min) or those values provided above and require an external mechanically driven power device to drive energy into the stream of products to be reacted. By contacting the reactants with the rotating members, which can be made from, coated with, or impregnated with stationary catalyst, significant energy is transferred to the reaction. The energy consumption of the HSD 40 will generally be very low. The temperature may be adjusted as desired to effect desired sulfur removal.

In some embodiments, HSD 40 is capable of delivering at least 300 L/h at a tip speed of at least 22.9 m/s (4500 ft/min). The power consumption may be about 1.5 kW. HSD 40 combines high tip speed with a very small shear gap to produce significant shear on the material being processed. The amount of shear will be dependent on the viscosity of the fluid in HSD 40. Accordingly, a local region of elevated pressure and temperature is created at the tip of the rotor during operation of HSD 40. In some cases the locally elevated pressure is about 1034.2 MPa (150,000 psi). In some cases the locally elevated temperature is about 500° C. In some cases, these local pressure and temperature elevations may persist for nano- or pico-seconds.

An approximation of energy input into the fluid (kW/L/min) can be estimated by measuring the motor energy (kW) and fluid output (L/min). As mentioned above, tip speed is the velocity (ft/min or m/s) associated with the end of the one or more revolving elements that is creating the mechanical force applied to the fluid. In embodiments, the energy expenditure is at least about 1000 $W/m^3$, 5000 $W/m^3$, 7500 $W/m^3$, 1 $kW/m^3$, 500 $kW/m^3$, 1000 $kW/m^3$, 5000 $kW/m^3$, 7500 $kW/m^3$, or greater. In embodiments, the energy expenditure of HSD 40 is greater than 1000 watts per cubic meter of fluid therein. In embodiments, the energy expenditure of HSD 40 is in the range of from about 3000 $W/m^3$ to about 7500 $kW/m^3$. In embodiments, the energy expenditure of HSD 40 is in the range of from about 3000 $W/m^3$ to about 7500 $W/m^3$. The actual energy input needed is a function of what reactions are occurring within the HSD, for example, endothermic and/or exothermic reaction(s), as well as the mechanical energy required for dispersing and mixing feedstock materials. In some applications, the presence of exothermic reaction(s) occurring within the HSD mitigates some or substantially all of the reaction energy needed from the motor input. When dispersing a gas in a liquid, the energy requirements are significantly less.

The shear rate is the tip speed divided by the shear gap width (minimal clearance between the rotor and stator). The shear rate generated in HSD 40 may be in the greater than 20,000 $s^{-1}$. In some embodiments the shear rate is at least 30,000 $s^{-1}$ or at least 40,000 $s^{-1}$. In some embodiments the shear rate is greater than 30,000 $s^{-1}$. In some embodiments the shear rate is at least 100,000 $s^{-1}$. In some embodiments the shear rate is at least 500,000 $s^{-1}$. In some embodiments the shear rate is at least 1,000,000 $s^{-1}$. In some embodiments the shear rate is at least 1,600,000 $s^{-1}$. In some embodiments the shear rate is at least 3,000,000 $s^{-1}$. In some embodiments the shear rate is at least 5,000,000 $s^{-1}$. In some embodiments the shear rate is at least 7,000,000 $s^{-1}$. In some embodiments the shear rate is at least 9,000,000 $s^{-1}$. In embodiments where the rotor has a larger diameter, the shear rate may exceed about 9,000,000 $s^{-1}$. In embodiments, the shear rate generated by HSD 40 is in the range of from 20,000 $s^{-1}$ to 10,000,000 $s^{-1}$. For example, in one application the rotor tip speed is about 40 m/s (7900 ft/min) and the shear gap width is 0.0254 mm (0.001 inch), producing a shear rate of 1,600,000 $s^{-1}$. In another application the rotor tip speed is about 22.9 m/s (4500 ft/min) and the shear gap width is 0.0254 mm (0.001 inch), producing a shear rate of about 901,600 $s^{-1}$.

In some embodiments, HSD 40 comprises a colloid mill. Suitable colloidal mills are manufactured by IKA® Works, Inc. Wilmington, N.C. and APV North America, Inc. Wilmington, Mass., for example. In some instances, HSD 40 comprises the DISPAX REACTOR® of IKA® Works, Inc.

In some embodiments, each stage of the external HSD has interchangeable mixing tools, offering flexibility. For example, the DR 2000/4 DISPAX REACTOR® of IKA® Works, Inc. Wilmington, N.C. and APV North America, Inc. Wilmington, Mass., comprises a three stage dispersing module. This module may comprise up to three rotor/stator combinations (generators), with choice of fine, medium, coarse, and super-fine for each stage. This allows for variance of shear rate along the direction of flow. In some embodiments, each of the stages is operated with super-fine generator.

Figure 2:
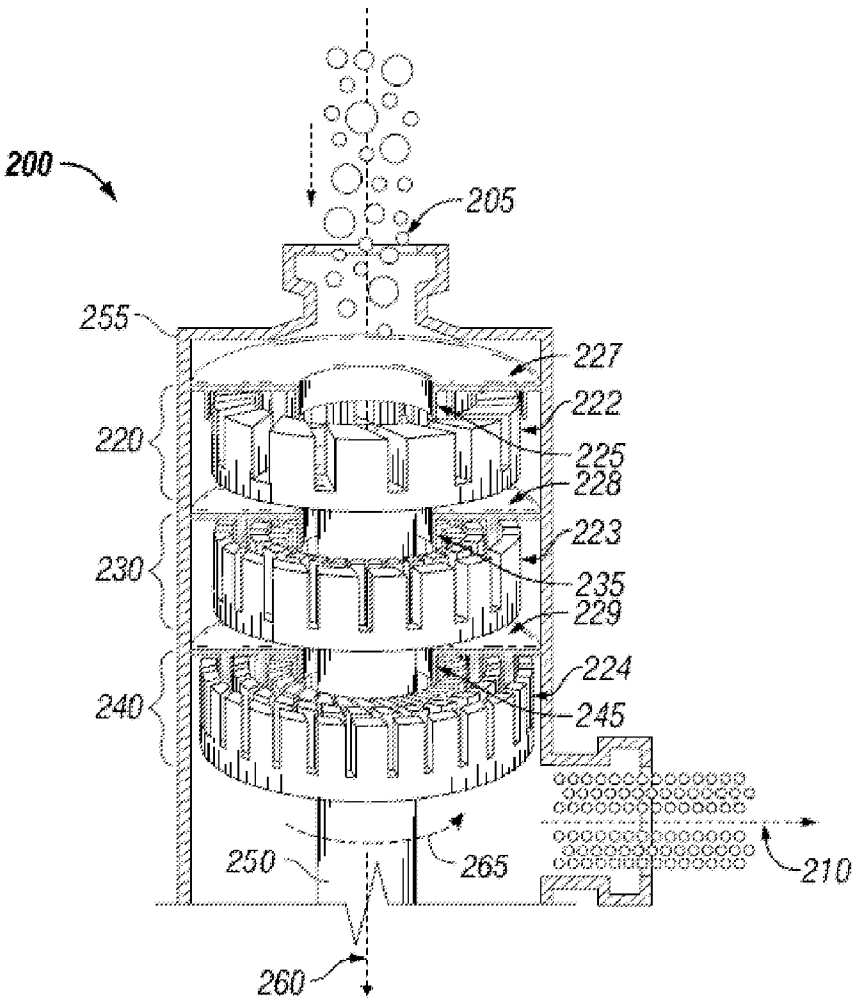
FIG. 2 is a longitudinal cross-section view of a high shear mixing device suitable for use in embodiments of the disclosed system.

In embodiments, a scaled-up version of the DISPAX® reactor is utilized. For example, in embodiments HSD 40 comprises a SUPER DISPAX REACTOR® DRS 2000. The HSD unit may be a DR 2000/50 unit, having a flow capacity of 125,000 liters per hour, or a DRS 2000/50 having a flow capacity of 40,000 liters/hour. Because residence time is increased in the DRS unit, the fluid therein is subjected to more shear. Referring now to FIG. 2, there is presented a longitudinal cross-section of a suitable HSD 200. HSD 200 of FIG. 2 is a dispersing device comprising three stages or rotor-stator combinations, 220, 230, and 240. The rotor-stator combinations may be known as generators 220, 230, 240 or stages without limitation. Three rotor/stator sets or generators 220, 230, and 240 are aligned in series along drive shaft 250.

First generator 220 comprises rotor 222 and stator 227. Second generator 230 comprises rotor 223, and stator 228. Third generator 240 comprises rotor 224 and stator 229. For each generator the rotor is rotatably driven by input 250 and rotates about axis 260 as indicated by arrow 265. The direction of rotation may be opposite that shown by arrow 265 (e.g., clockwise or counterclockwise about axis of rotation 260). Stators 227, 228, and 229 may be fixably coupled to the wall 255 of HSD 200. As mentioned hereinabove, each rotor and stator may comprise rings of complementarily-shaped tips, leading to several shear gaps within each generator.

As mentioned hereinabove, each generator has a shear gap width which is the minimum distance between the rotor and the stator. In the embodiment of FIG. 2, first generator 220 comprises a first shear gap 225; second generator 230 comprises a second shear gap 235; and third generator 240 comprises a third shear gap 245. In embodiments, shear gaps 225, 235, 245 have widths in the range of from about 0.025 mm to about 10 mm. Alternatively, the process comprises utilization of an HSD 200 wherein the gaps 225, 235, 245 have a width in the range of from about 0.5 mm to about 2.5 mm. In certain instances the shear gap width is maintained at about 1.5 mm. Alternatively, the width of shear gaps 225, 235, 245 are different for generators 220, 230, 240. In certain instances, the width of shear gap 225 of first generator 220 is greater than the width of shear gap 235 of second generator 230, which is in turn greater than the width of shear gap 245 of third generator 240. As mentioned above, the generators of each stage may be interchangeable, offering flexibility. HSD 200 may be configured so that the shear rate remains the same or increases or decreases stepwise longitudinally along the direction of the flow 260.

Generators 220, 230, and 240 may comprise a coarse, medium, fine, and super-fine characterization, having different numbers of complementary rings or stages on the rotors and complementary stators. Rotors 222, 223, and 224 and stators 227, 228, and 229 may be toothed designs. Each generator may comprise two or more sets of complementary rotor-stator rings. In embodiments, rotors 222, 223, and 224 comprise more than 3 sets of complementary rotor/stator rings. In embodiments, the rotor and the stator comprise no teeth, thus forcing the reactants to flow through the pores of a sintered material.

HSD 40 may be a large or small scale device. In embodiments, system 100 is used to process from less than 100 gallons per minute to over 5000 gallons per minute. In embodiments, one or more HSD 40 processes at least 100, 500, 750, 900, 1000, 2000, 3000, 4000, 5000 gpm or more. Large scale units may produce 1000 gal/h (24 barrels/h). The inner diameter of the rotor may be any size suitable for a desired application. In embodiments, the inner diameter of the rotor is from about 12 cm (4 inch) to about 40 cm (15 inch). In embodiments, the diameter of the rotor is about 6 cm (2.4 inch). In embodiments, the outer diameter of the stator is about 15 cm (5.9 inch). In embodiments, the diameter of the stator is about 6.4 cm (2.5 inch). In some embodiments the rotors are 60 cm (2.4 inch) and the stators are 6.4 cm (2.5 inch) in diameter, providing a clearance of about 4 mm. In certain embodiments, each of three stages is operated with a super-fine generator comprising a number of sets of complementary rotor/stator rings.

HSD 200 is configured for receiving at inlet 205 a fluid mixture from line 13. The mixture comprises reactants, as discussed further hereinbelow. In embodiments, the reactants comprise oil and desulfurizing agent. In embodiments, the reactants comprise crude oil and desulfurizing agent. In embodiments, the reactants comprise crude oil and aqueous ammonia. In embodiments, the reactants comprise crude oil and ammonium sulfate. In embodiments, the reactants comprise crude oil and potassium hydroxide. In embodiments, the reactants comprise crude oil and caustic. In embodiments, the reactants further comprise at least one API-adjustment gas, as discussed further hereinbelow. Feed stream entering inlet 205 is pumped serially through generators 220, 230, and then 240, such that product sweetened oil is produced. Product exits HSD 200 via outlet 210 (and line 19 of FIG. 1). The rotors 222, 223, 224 of each generator rotate at high speed relative to the fixed stators 227, 228, 229, providing a high shear rate. The rotation of the rotors pumps fluid, such as the feed stream entering inlet 205, outwardly through the shear gaps (and, if present, through the spaces between the rotor teeth and the spaces between the stator teeth), creating a localized high shear condition. High shear forces exerted on fluid in shear gaps 225, 235, and 245 (and, when present, in the gaps between the rotor teeth and the stator teeth) through which fluid flows process the fluid and create desulfurized oil product. The product may comprise an emulsion containing sweetened oil and released sulfur. The high shear-treated stream 19 may comprise spent desulfurizing agent, excess desulfurizing agent, altered desulfurizing agent, or some combination thereof, as will be discussed hereinbelow. Product exits HSD 200 via high shear outlet 210 (lines 19 of FIG. 1).

As mentioned above, in certain instances, HSD 200 comprises a DISPAX REACTOR® of IKA® Works, Inc. Wilmington, N.C. and APV North America, Inc. Wilmington, Mass. Several models are available having various inlet/outlet connections, horsepower, tip speeds, output rpm, and flow rate. Selection of the HSD will depend on throughput selection, for example. IKA® model DR 2000/4, for example, comprises a belt drive, 4M generator, PTFE sealing ring, inlet flange 25.4 mm (1 inch) sanitary clamp, outlet flange 19 mm (¾ inch) sanitary clamp, 2 HP power, output speed of 7900 rpm, flow capacity (water) approximately 300-700 L/h (depending on generator), a tip speed of from 9.4-41 m/s (1850 ft/min to 8070 ft/min). Scale up may be performed by using a plurality of HSDs, or by utilizing larger HSDs. Scale-up using larger models is readily performed, and results from larger HSD units may provide improved efficiency in some instances relative to the efficiency of lab-scale devices. The large scale unit may be a DISPAX® 2000/unit. For example, the DRS 2000/5 unit has an inlet size of 51 mm (2 inches) and an outlet of 38 mm (1.5 inches).

In embodiments HSD 40 or portions thereof are manufactured from refractory/corrosion resistant materials. For example, sintered metals, INCONEL® alloys, HASTELLOY® materials may be used. For example, the desulfurizing agent may be very caustic, so the rotors, stators, and/or other components of HSD 40 may be manufactured of refractory materials (e.g. sintered metal) in various applications.

Separation Unit(s) 10.

Oil desulfurization system 100 comprises one or more separation unit(s) 10. Separation unit(s) 10 can be any type of separation vessel configured to separate phases and/or materials of different densities. In embodiments, separation unit(s) 10 is selected from centrifuges, decanters and filtration units. In embodiments, separation unit 10 comprises one or more centrifuges. In embodiments, separation unit(s) 10 comprises a single centrifuge. In embodiments, separation unit 10 comprises one or more filtration units. Separation unit(s) 10 may be operable continuously, semi-continuously, or in batches. One or more separation unit(s) 10 may be configured in series or in parallel. For parallel operation, outlet line 19 may divide to introduce high shear-treated product into multiple separation unit(s) 10. In embodiments, the components separated in separation unit(s) 10 are selected from sulfur, sweetened oil, desulfurizing agent or any combination thereof. In the embodiment of FIG. 1, separation unit 10 comprises first separator outlet line 16, second separator outlet line 17 and third separator outlet line 20.

Separation unit(s) 10 may include one or more of the following components: heating and/or cooling capabilities, pressure measurement instrumentation, temperature measurement instrumentation, one or more injection points, and level regulator, as are known in the art of separator design. For example, a heating and/or cooling apparatus may comprise, for example, a heat exchanger.

Heat Transfer Devices.

Internal or external heat transfer devices for heating the fluid to be treated are also contemplated in variations of the system. For example, the reactants may be preheated via any method known to one skilled in the art. Some suitable locations for one or more such heat transfer devices are between pump 5 and HSD 40, between HSD 40 and flow line 19, and between flow line 17 and pump 5 when fluid in second separator outlet 17 is recycled to HSD 40. HSD may comprise an inner shaft which may be cooled, for example water-cooled, to partially or completely control the temperature within the HSD. Some non-limiting examples of such heat transfer devices are shell, tube, plate, and coil heat exchangers, as are known in the art.

Pumps.

High shear oil desulfurization system 100 may comprise pump 5. Pump 5 is configured for either continuous or semi-continuous operation, and may be any suitable pumping device that is capable of providing controlled flow through HSD 40 and system 100. In applications pump 5 provides greater than 202.65 kPa (2 atm) pressure or greater than 303.97 kPa (3 atm) pressure. Pump 5 may be a Roper Type 1 gear pump, Roper Pump Company (Commerce, Ga.) Dayton Pressure Booster Pump Model 2P372E, Dayton Electric Co (Niles, Ill.) is one suitable pump. Preferably, all contact parts of the pump comprise stainless steel, for example, 316 stainless steel. In some embodiments of the system, pump 5 is capable of pressures greater than about 2026.5 kPa (20 atm). In addition to pump 5, one or more additional, high pressure pumps may be included in the system illustrated in FIG. 1. For example, a booster pump, which may be similar to pump 5, may be included between HSD 40 and flow line 19 for boosting the pressure into flow line 19. When oil source 15 is an oil well, i.e., when high shear system 100 is located near an oil well, the crude oil may be introduced at pressure, and no pump 5 may be utilized.

High Shear Process for Sweetening Oil.

Figure 3:
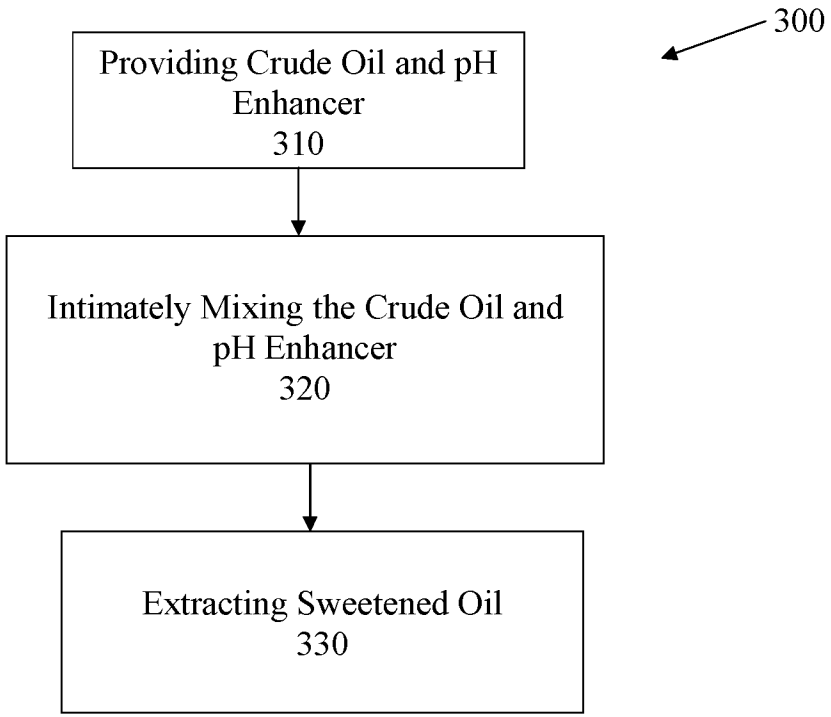
FIG. 3 is a box flow diagram of a method of removing sulfur from oil according to an embodiment of this disclosure.

A process for sweetening oil will now be described with respect to FIG. 3 which is a schematic of a method 300 of producing sweetened oil according to an embodiment of this disclosure. Process 300 comprises providing oil and desulfurizing agent at 310; intimately mixing the oil and desulfurizing agent to produce a high shear-treated stream at 320; and extracting sweetened oil from the high shear-treated stream at 330. The sulfur removal system is operable as a closed loop. In embodiments, no distillation, no settling tanks, and/or no external heating is required to effect desulfurization of oil via the disclosed method.

Providing Oil to be Sweetened and Desulfurizing Agent 310.

Process 300 comprises providing oil to be sweetened and providing desulfurizing agent(s) 310. The oil to be sweetened may be crude oil. The oil to be treated may be introduced directly following extraction from an oil well, and may thus be at elevated temperature and/or pressure. In embodiments, no heating is utilized, and the system exposed to ambient temperature. In embodiments, oil source 15 comprises an oil well. In embodiments, the oil to be sweetened is held in a storage unit. Thus, in embodiments, oil source 15 comprises a storage vessel as known in the art.

The oil to be sweetened may comprise organic and/or inorganic forms of sulfur. For example, the oil to be sweetened may comprise, for example, hydrogen sulfide, organic sulfides, organic disulfides, mercaptans (also known as thiols), and aromatic ring compounds, such as thiophene, benzothiophene and related compounds. The sulfur in aromatic ring compounds will be herein referred to as 'thiophene sulfur.' The liquid oil extracted from oil shale as well as that derived from tar sands is referred to as syncrude. The oil to be sweetened may be petroleum or syncrude. The oil to be sweetened may be refined oil or used refined oil. The oil to be treated may also comprise chloride, mercury, vanadium, and/or other heavy metals which may also be advantageously removed during the disclosed sulfur removal process, as discussed further hereinbelow.

In embodiments, providing oil to be sweetened comprises providing one or more crude oils. Crude oils are naturally occurring complex mixtures of hydrocarbons that typically include small quantities of sulfur, nitrogen, and oxygen derivatives of hydrocarbons as well as trace metals. Crude oils contain many different hydrocarbon compounds that vary in appearance and composition from one oil field to another. Crude oils range in consistency from water to tar-like solids, and in color from clear to black. An 'average' crude oil contains about 84% carbon, 14% hydrogen, 1%-3% sulfur, and less than 1% each of nitrogen, oxygen, metals, and salts. Crude oils are generally classified as paraffinic, naphthenic, or aromatic, based on the predominant proportion of similar hydrocarbon molecules. Mixed-base crudes contain varying amounts of each type of hydrocarbon. Refinery crude base stocks usually contain mixtures of two or more different crude oils.

Relatively simple crude oil assays are used to classify crude oils as paraffinic, naphthenic, aromatic, or mixed. One assay method (United States Bureau of Mines) is based on distillation, and another method (UOP 'K' factor) is based on gravity and boiling points. More comprehensive crude assays may be utilized to estimate the value of the crude (i.e., yield and quality of useful products) and processing parameters. Crude oils are typically grouped according to yield structure.

Crude oils are also defined in terms of API (American Petroleum Institute) gravity. API gravity is an arbitrary scale expressing the density of petroleum products. The higher the API gravity, the lighter the crude. For example, light crude oils have high API gravities and low specific gravities. Crude oils with low carbon, high hydrogen, and high API gravity are usually rich in paraffins and tend to yield greater proportions of gasoline and light petroleum products, while those with high carbon, low hydrogen, and low API gravities are usually rich in aromatics.

Crude oils that contain appreciable quantities of hydrogen sulfide or other reactive sulfur compounds are referred to as 'sour.' Crude oils containing less sulfur are referred to as 'sweet.' A notable exceptions to this rule are West Texas crude oils, which are always considered 'sour' regardless of their hydrogen sulfide content, and Arabian high-sulfur crudes, which are not considered 'sour' because the sulfur compounds therein are not highly reactive. Providing crude oil at 310 may comprise providing one or more selected from sour crude oils. The sour crude oils may be low API crude oils, high API crude oils, medium API crude oils, paraffinic crude oils, naphthenic crude oils, aromatic crude oils, mixed crude oils, or any combination thereof. Table 1 shows typical characteristics, properties, and gasoline potential of various crude oils. In embodiments, providing oil to be sweetened at 310 comprises providing one or more crude oil similar to those presented in Table 1.

TABLE 1

Typical Approximate Characteristics, Properties and Gasoline Potential of Various Crude Oils*

| Source | Paraffins (vol. %) | Aromatics (vol. %) | Naphthenes (vol. %) | Sulfur (wt. %) | ~API Gravity | Napht. Yield (vol. %) | Octane # (est.) |
|---|---|---|---|---|---|---|---|
| Nigerian-Light | 37 | 9 | 54 | 0.2 | 36 | 28 | 60 |
| Saudi-Light | 63 | 19 | 18 | 2 | 34 | 22 | 40 |
| Saudi-Heavy | 60 | 15 | 25 | 2.1 | 28 | 23 | 35 |
| Venezuela-Heavy | 35 | 12 | 53 | 2.3 | 30 | 2 | 60 |
| Venezuela-Light | 52 | 14 | 34 | 1.5 | 24 | 18 | 50 |
| USA-Midcont. Sweet | — | — | — | 0.4 | 40 | — | — |
| USA- W. Texas Sour | 46 | 22 | 32 | 1.9 | 32 | 33 | 55 |
| North Sea-Brent | 50 | 16 | 34 | 0.4 | 37 | 31 | 50 |

*(representative average values)

The oil to be sweetened may comprise about 5, 4, 3, 2 or 1 weight percent sulfur. In embodiments, the oil to be sweetened comprises from about 0.2 to about 20 ppm sulfur. In embodiments, the oil to be sweetened comprises from about 0.2 to about 10 ppm sulfur. In embodiments, the oil to be sweetened comprises from about 5 to about 10 ppm sulfur. In embodiments, the oil to be sweetened comprises from about 0.1 to about 5 ppm thiophene sulfur.

Providing oil to be sweetened and desulfurizing agent at 310 comprises providing at least one desulfurizing agent. In embodiments, providing oil and desulfurizing agent comprises providing a 50:50 volume mixture of oil and desulfurizing agent. In embodiments, the desulfurizing agent is a base. The desulfurizing agent may be caustic. In embodiments, the desulfurizing agent is selected from the group consisting of ammonia, sodium hydroxide, potassium hydroxide, ammonium sulfate, calcium carbonate, hydrogen, hydrogen peroxide, monoethanolamine (MEA), diglycolamine (DGA), diethanolamine (DEA), diisopropanolamine (DIPA) and methyldiethanolamine (MDEA). In embodiments, the desulfurizing agent is aqueous ammonia. In embodiments, the desulfurizing agent is 28% aqueous ammonia (28% $NH_4OH$). In embodiments, the desulfurizing agent comprises an inorganic salt. In embodiments, the desulfurizing agent comprises calcium carbonate. In embodiments, the desulfurizing agent comprises ammonium sulfate. Ammonium sulfate may be formed within HSD 40 (when aqueous ammonia is initially introduced as desulfurizing agent into HSD 40) and recycled for use as desulfurizing agent. Alternatively, ammonium sulfate may be purchased and introduced into HSD 40. Alternatively, ammonium sulfate may be produced on site, for example, from dry ammonium sulfate and water.

Intimately Mixing Oil and Desulfurizing Agent 320.

Process 300 comprises intimately mixing the oil to be sweetened and the desulfurizing agent(s) at 320. Intimately mixing may comprise subjecting the oil to be sweetened and the desulfurizing agent(s) to high shear to produce a high shear-treated stream. In embodiments, subjecting the oil to be sweetened and the desulfurizing agent(s) to high shear comprises subjecting to a shear rate of at least 10,000 $s^{-1}$, at least 20,000 $s^{-1}$, at least 30,000 $s^{-1}$, or higher, as further discussed hereinbelow. In embodiments, intimately mixing the oil and desulfurizing agent 320 comprises introducing the oil to be sweetened (e.g., via lines 21 and 13) and the desulfurizing agent(s) (e.g., via line 22) into a HSD 40, as indicated in FIG. 1.

Referring now to FIG. 1, intimately mixing the oil and desulfurizing agent(s) 320 may comprise introducing the oil to be sweetened from oil source 15 into HSD 40. Pump 5 is used to pump the oil into HSD 40. The desulfurizing agent(s) may be introduced into line 13 via line 22 or elsewhere throughout system 100. For example, fresh or makeup ammonia may be introduced via line 22. In embodiments, gas is introduced into HSD 40 along with the oil to be sweetened and the desulfurizing agent(s). For example, gas may be introduced into HSD 40 via line 22, via an additional inlet line, may be introduced directly into HSD 40, or may be present in the oil introduced from oil source 15. When line 22 is utilized for the introduction of desulfurizing agent(s), a second line may introduce gas into line 13.

The introduction of gas into HSD 40 along with desulfurizing agent may be utilized to alter the API of the resulting sweetened crude oil. Generally, refining of crude oil produces significant amounts of refinery-related gas. Generally 5% or so of the crude oil is converted to various gases during refinery operations). Such gases are typically used as fuel or flared. The use of such gas for API enhancement may be desirable over the flaring of such gas, especially in view of progressively tighter emissions restrictions. Additionally, passing the API adjustment gas through the HSD along with the desulfurizing agent may serve to clean the gas (i.e. remove sulfur (such as hydrogen sulfide) therefrom). A significant portion of the gas may be consumed in reactions in the HSD. Any remaining gas may be recycled to HSD 40, flared, or used for fuel.

The method may serve to alter the API gravity and/or stabilize the crude oil, by reducing volatile components therein, and also sweeten the oil by removal of sulfur therefrom. It is noted that even in the absence of gas addition, intimately mixing the oil to be sweetened and the desulfurizing agent(s) may effectively raise the API gravity. For example, removal of sulfur from crude oil comprising thiophene compounds may result in sweetened oil having a higher API gravity than the sour crude oil introduced thereto.

The refinery-related gas may comprise various amounts of carbon dioxide, carbon monoxide, hydrogen, methane, ethane, and/or hydrogen sulfide, for example. In embodiments, the API adjustment gas is or comprises carbon dioxide. Additionally, crude oil may be extracted from the earth in conjunction with associated gas. Associated gas is gas found dissolved in crude oil at the high pressures existing in a reservoir, or gas present as a gas cap over the oil. Associated gas comprises natural gas. Unassociated gas may also be available. The phrase 'unassociated gas' herein refers to gas obtained in a reservoir in the absence of oil, as known in the art. The gas introduced into HSD along with desulfurizing agent may be selected from, but is not limited to: FCC offgas, pyrolysis gas, associated gas, hydrodesulfurization offgas, catalytic cracker offgas, thermal cracker offgas, unassociated gas, and combinations thereof. For example, regeneration of FCC catalyst in a refinery may produce significant quantities of CO and/or $CO_2$, which may be introduced into the HSD along with the desulfurizing agent(s). The gas may be selected from associated gas, unassociated gas, refinery-related gas, methane, ethane, carbon monoxide, carbon dioxide, hydrogen and combinations thereof. In embodiments, crude oil extracted from the earth with associated gas is intimately mixed via HSD 40 (desirably before pressure reduction) with desulfurizing agent to adjust the stability and/or the API gravity thereof and remove sulfur therefrom. In embodiments, crude oil extracted from the earth (with or without associated gas) is intimately mixed with unassociated gas and desulfurizing agent(s) via HSD 40 to adjust the stability/API gravity thereof and remove sulfur therefrom. The removal of sulfur within HSD 40 will enhance interaction of the gas with the crude oil, and a substantial portion of the gas introduced into HSD 40 may be consumed. The presence, in the crude oil, of vanadium and other metals having catalytic properties, may enhance the reaction of the crude oil with the API-adjustment gas.

Referring now to FIG. 1, when present, pump 5 may be operated to pump the oil to be sweetened through line 13, and to build pressure and feed HSD 40, providing a controlled flow throughout high shear (HSD) 40 and high shear system 100. In some embodiments, pump 5 increases the pressure of the HSD inlet stream in line 13 to greater than 200 kPa (2 atm) or greater than about 300 kPa (3 atmospheres). In this way, high shear system 100 may combine high shear with pressure to enhance production of sweetened oil. As mentioned above, when the crude oil is sweetened at the wellhead or well site, the oil may have suitable pressure as extracted from the ground, in which case, pump 5 is not utilized.

Within high shear device 40, desulfurizing agent(s) and optionally API-adjustment gas are intimately mixed with the oil to be sweetened. The temperature, shear rate and/or residence time within HSD 40 may be controlled to effect desired sulfur removal. For example, the operating parameters may be selected/adjusted to produce sweetened oil having less than a desired sulfur content. The desired sulfur content may be less than 2 weight percent sulfur, less than 1.5 weight percent sulfur, less than 1.0 weight percent sulfur, less than 0.75 weight percent sulfur, less than 0.5 weight percent sulfur, or less than about 0.25 weight percent sulfur.

Subjecting the oil and desulfurizing agent (and optionally API adjustment gas) to high shear may provide an emulsion or dispersion comprising droplets of the desulfurizing agent or oil or bubbles of the API adjustment gas. In embodiments, an emulsion or dispersion comprising nano droplets and/or micro droplets of liquid and/or nanobubbles and/or microbubbles of the API-adjustment gas is formed. In embodiments, the droplets in the emulsion and/or the bubbles in the dispersion have an average diameter of less than or about 5, 4, 3, 2 or 1 μm. In embodiments, the droplets in the emulsion and/or the bubbles in the dispersion have an average particle diameter in the nanometer range, the micron range, or the submicron range.

Within HSD 40, the contents are subjected to high shear. In an exemplary embodiment, the high shear device comprises a commercial disperser such as IKA® model DR 2000/4, a high shear, three stage dispersing device configured with three rotors in combination with stators, aligned in series, as described above. The disperser is used to subject the contents to high shear. The rotor/stator sets may be configured as illustrated in FIG. 2, for example. In such an embodiment, the feed enters the high shear device via line 13 and enter a first stage rotor/stator combination having circumferentially spaced first stage shear openings. The coarse mixture exiting the first stage enters the second rotor/stator stage, which has second stage shear openings. The mixture emerging from the second stage enters the third stage rotor/stator combination having third stage shear openings. The rotors and stators of the generators may have circumferentially spaced complementarily-shaped rings. A high shear-treated stream exits the high shear device via line 19. In some embodiments, the shear rate increases stepwise longitudinally along the direction of the flow 260, or going from an inner set of rings of one generator to an outer set of rings of the same generator. In other embodiments, the shear rate decreases stepwise longitudinally along the direction of the flow, 260, or going from an inner set of rings of one generator to an outer set of rings of the same generator (outward from axis 200). For example, in some embodiments, the shear rate in the first rotor/stator stage is greater than the shear rate in subsequent stage(s). For example, in some embodiments, the shear rate in the first rotor/stator stage is greater than or less than the shear rate in a subsequent stage(s). In other embodiments, the shear rate is substantially constant along the direction of the flow, with the stage or stages being the same. If HSD 40 includes a PTFE seal, for example, the seal may be cooled using any suitable technique that is known in the art. The HSD 40 may comprise a shaft in the center which may be used to control the temperature within HSD 40. For example, the desulfurizing agent flowing in line 22 may be used to cool the seal and in so doing be preheated prior to entering the high shear device.

The rotor(s) of HSD 40 may be set to rotate at a speed commensurate with the diameter of the rotor and the desired tip speed. As described above, the HSD (e.g., colloid mill or toothed rim disperser) has either a fixed clearance between the stator and rotor or has adjustable clearance.

In some embodiments, HSD 40 delivers at least 300 L/h at a nominal tip speed of at least 22 m/s (4500 ft/min), 40 m/s (7900 ft/min), and which may exceed 225 m/s (45,000 ft/min) or greater. The power consumption may be about 1.5 kW or higher as desired. Although measurement of instantaneous temperature and pressure at the tip of a rotating shear unit or revolving element in HSD 40 is difficult, it is estimated that the localized temperature seen by the intimately mixed reactants may be in excess of 500° C. and at pressures in excess of 500 kg/cm$^2$ under high shear conditions.

Conditions of temperature, pressure, space velocity, API-adjustment gas composition, and/or ratio of desulfurizing agent to oil to be sweetened may be adjusted to effect a desired sulfur removal. Such parameters may be adjusted as the composition of the crude oil to be treated varies. In some embodiments, the operating temperature and pressure are determined by the temperature and pressure at which the crude oil exits the wellhead. The residence time within HSD 40 is typically low. For example, the residence time can be in the millisecond range, can be about 10, 20, 30, 40, 50, 60, 70, 80, 90 or about 100 milliseconds, can be about 100, 200, 300, 400, 500, 600, 700, 800, or about 900 milliseconds, can be in the range of seconds, or can be any range thereamong.

As mentioned above, intimately mixing the crude oil with the desulfurizing agent(s) may comprise running the crude oil through one or more HSDs 40. Intimately mixing the crude oil with the desulfurizing agent(s) may comprise running the crude oil through two or more HSDs 40, in series or in parallel. Intimately mixing the crude oil with the desulfurizing agent(s) may comprise running the crude oil through three or more HSDs 40, in series and/or in parallel. Additional API-adjustment gas and/or desulfurizing agent(s) may be introduced into each subsequent HSD.

Without wishing to be limited by theory, when aqueous ammonia and/or ammonium sulfate are introduced into HSD 40 as desulfurizing agent(s), ammonium sulfate present within HSD 40 will repetitively release sulfur and extract further sulfur from the oil. The presence of elemental sulfur will effect removal of chloride, mercury, vanadium, and other heavy metals which may have been present in the oil to be sweetened. Thus, sulfur removal may be combined with chloride and/or heavy metal removal via the disclosed system and method.

Without wishing to be limited by theory, it is believed that the conditions within HSD 40 force reactions that would otherwise not be thermodynamically favorable. In embodiments, the desulfurizing agent(s) introduced into HSD 40 comprises aqueous ammonia or ammonium sulfate. The ammonium sulfate formed within HSD 40 or introduced as desulfurizing agent (e.g. introduced into HSD 40 via line 22 or recycled from separation unit(s) 10, as discussed further hereinbelow) sequentially removes sulfur from the oil. The ammonium sulfate may thus be considered a catalyst in the desulfurization, consecutively removing sulfur from the oil, releasing elemental sulfur (due to the shear/pressure), and extracting subsequent sulfur molecules from the oil.

Extracting Sweetened Oil 330.

High shear sulfur removal method 300 further comprises extracting sweetened oil at 330. Extracting sweetened oil 330 comprises separating sweetened oil from high shear-treated stream 19. During intimately mixing 320, the desulfurizing agent may be converted to a new form. For example, when fresh aqueous ammonia is introduced into HSD 40 along with oil to be sweetened, ammonium sulfate will form within HSD 40. Extracting sweetened oil may thus comprise separating sweetened oil from sulfur and desulfurizing agent(s), which may comprise the same desulfurizing agent originally introduced into HSD 40 or may comprise a desulfurizing agent formed within HSD 40 (e.g., ammonium sulfate). In embodiments, desulfurizing agent(s) are extracted from separation unit(s) 10 via second separator outlet 17; sweetened oil is removed from separation unit(s) 10 via first separator outlet 16; and (solid) sulfur is removed from separation unit(s) 10 via third separator outlet 20. As mentioned above, in embodiments, API-adjustment gas is introduced into HSD 40 along with desulfurizing agent(s) and oil. Any unreacted gas or produced gas may be removed upstream of separation unit(s) 10 or removed from separation unit(s) 10. Unreacted or product gas may be recycled as desired to HSD 40 or to a different HSD, or used as fuel or flared.

As discussed hereinabove, separation unit(s) may be selected from centrifuges, filtration devices (e.g. filter press), decanters, and combinations thereof. In embodiments, separation unit(s) 10 is one or more centrifuges.

In embodiments, the desulfurizing agent(s) introduced into HSD 40 or formed therein act as a catalyst in the sulfur removal process. In such instances, for example when desulfurizing agent comprising aqueous ammonia is introduced into HSD 40 (and ammonium sulfate is formed within HSD 40) or when ammonium sulfate is introduced into HSD 40, desulfurizing agent separated from high shear-treated stream 19 may be recycled from separation unit(s) 10 to HSD 40 by fluidly connecting second outlet 17 with line 22, line 21, or line 13, whereby a portion of the contents of second outlet line 17 may be recycled to HSD 40, or by introducing the contents of line 17 (or a portion thereof) directly into HSD 40. The separated desulfurizing agent may comprise the same desulfurizing agent introduced into HSD 40 (e.g., unreacted aqueous ammonia or ammonium sulfate introduced into HSD 40) or desulfurizing agent formed within HSD 40 (e.g., ammonium sulfate formed within HSD 40 due to introduction of aqueous ammonia into HSD 40). Recycle of desulfurizing agent(s) may be desirable, to reduce the amount of desulfurizing agent utilized in the desulfurization. For example, initially, aqueous ammonia may be introduced into HSD 40 via line 22. Within HSD 40, ammonium sulfate is formed, which repetitively extracts sulfur from the oil to be sweetened. The ammonium sulfate is separated from the sweetened oil product (which exits separation unit(s) 10 via first separator outlet 16) and solid removed sulfur (which exits separation unit(s) 10 via third separator outlet 20) and some or all of the ammonium sulfate is recycled to HSD 40 via second separator outlet 17. In such instances, introduction of fresh aqueous ammonia may be terminated when sufficient ammonium sulfate has been produced and is available for recycle to HSD 40. This is desirable, for example, as aqueous ammonia must be handled carefully, and because, especially for large scale operation, cost can be significantly reduced by utilizing recycled material rather than by using massive volumes of fresh desulfurizing agent. Should ammonium sulfate be desirable as sale product or for use elsewhere, ammonium sulfate may not be recycled. Alternatively or additionally, ammonium sulfate may be recycled through system 100 and sulfur removed primarily as elemental sulfur (e.g. sulfur crystals).

In other embodiments, the desulfurizing agent(s) is spent during operation, and altered desulfurizing agent is not recycled, but is removed from system 100 via second outlet 17. For example, when caustic is utilized as desulfurizing agent, NaCl may be formed, which does not reverse and extract further sulfur from the oil. In such instances, fresh caustic will need to be continually introduced as necessary into HSD 40 during operation.

Product Sweetened Oil.

The sweetened oil removed from separation unit(s) 10 comprises oil having a lower sulfur content than the oil to be sweetened. The sweetened oil may have a sulfur content of less than 2 weight percent sulfur, less than 1.5 weight percent sulfur, less than 1.0 weight percent sulfur, less than 0.75 weight percent sulfur, less than 0.5 weight percent sulfur, or less than about 0.25 weight percent sulfur. In embodiments, the sulfur content of the sweetened oil is less than 90, 80, 70, 60, 50, 40, 30, 20, or 10% of the sulfur content of the oil to be sweetened. For example, the sweetened oil may comprise 10% of the sulfur content of the crude oil introduced into HSD 40.

In embodiments, chloride is removed during desulfurization. Chloride may be removed as sodium chloride or ammonium chloride, for example. In embodiments, the chloride content of the sweetened oil is less than about 50%, 40%, 30%, 20%, 15%, or less than about 10% of the chloride content of the oil to be sweetened.

As mentioned above, removal of sulfur from the oil may beneficially alter the API gravity of the crude oil. Additionally, introduction of gas into HSD 40 along with oil to be sweetened and desulfurizing agent(s) may further enhance the API gravity and/or stability of the oil. In embodiments, the API of the sweetened oil product is at least or about 1.25, 1.5 or 2 times the API of the oil to be sweetened. In embodiments, the API of a crude oil is increased from about 15 to about 30, from about 5 to about 20, or from about 10 to about 20 via the disclosed method.

The sulfur removed from separation unit(s) 10 via third outlet 20 comprises solid sulfur, and will generally appear yellow. The sulfur may be present as regular sulfur or poly sulfur. Various allotropes of sulfur may be present in the removed sulfur, for example, S8, S7, S6 or combinations thereof. When desulfurizing agent comprises ammonia, sulfur is also removed as ammonium sulfate. The sulfur may be removed as a filter cake, as a slurry, or as a dry product, for example, from a centrifuge.

Multiple Pass Operation.

In the embodiment shown in FIG. 1, the system is configured for single pass operation. The output of HSD 40 may be run through a subsequent HSD. In some embodiments, it may be desirable to pass the contents of flow line 19, or a fraction thereof, through HSD 40 during a second pass. In this case, at least a portion of the contents of flow line 19 may be recycled from flow line 19 and optionally pumped by pump 5 into line 13 and thence into HSD 40. Additional reactants (e.g., API-adjustment gas and/or desulfurizing agent(s)) may be injected via line 22 into line 13, or may be added directly into the HSD. In other embodiments, product in outlet line 19 is fed into a second HSD prior to separation unit(s) 10. Due to the rapidity of the sulfur removal witnessed in the experiments performed to date, it appears that multiple pass operation may not be necessary or desirable.

Multiple HSDs.

In some embodiments, two or more HSDs like HSD 40, or configured differently, are aligned in series, and are used to promote further reaction. In embodiments, the reactants pass through multiple HSDs 40 in serial or parallel flow. In embodiments, a second HSD may be positioned downstream of separation unit(s) 10, whereby the sweetened oil exiting separation unit(s) 10 via first outlet 16 may be introduced into a subsequent HSD for removal of remaining sulfur therefrom. When multiple HSDs 40 are operated in series, additional reactants may be injected into the inlet feedstream of each HSD. For example, additional API adjustment gas and/or desulfurizing agent(s) may be introduced into a second or subsequent HSD 40. In some embodiments, multiple HSDs 40 are operated in parallel, and the outlet products therefrom are introduced into one or more flow lines 19.

Features.

The rate of chemical reactions involving liquids, gases and solids depend on time of contact, temperature, and pressure. In cases where it is desirable to react two or more raw materials of different phases or immiscible materials, one of the limiting factors controlling the rate of reaction involves the contact time of the reactants. When reaction rates are accelerated, residence times may be decreased, thereby increasing obtainable throughput.

The intimate contacting of reactants provided by the HSDs may allow and/or result in faster and/or more complete sulfur removal than simple mixing. In embodiments, use of the disclosed process comprising reactant mixing via external HSD allows use of reduced quantities of catalyst (e.g. ammonium sulfate) than conventional configurations and methods, and/or increases sulfur removal.

Without wishing to be limited to a particular theory, it is believed that the level or degree of high shear mixing may be sufficient to increase rates of mass transfer and also produce localized non-ideal conditions (in terms of thermodynamics) that enable reactions to occur that would not otherwise be expected to occur based on Gibbs free energy predictions and/or increase the rate or extent of expected reactions. For example, in conventional mixing of crude oil with aqueous ammonia, ammonium sulfate may form, but the catalytic effect of the ammonium sulfate and successive removal of additional sulfur from the oil to be sweetened by the ammonium sulfate due to the release of the sulfur at the high pressure/shear encountered in the HSD would not be expected to occur. Localized non ideal conditions are believed to occur within the HSD resulting in increased temperatures and pressures with the most significant increase believed to be in localized pressures. The increases in pressure and temperature within the HSD are instantaneous and localized and quickly revert back to bulk or average system conditions once exiting the HSD. Without wishing to be limited by theory, in some cases, the HSD may induce cavitation of sufficient intensity to dissociate one or more of the reactants into free radicals, which may intensify a chemical reaction or allow a reaction to take place at less stringent conditions than might otherwise be required. Cavitation may also increase rates of transport processes by producing local turbulence and liquid micro-circulation (acoustic streaming). An overview of the application of cavitation phenomenon in chemical/physical processing applications is provided by Gogate et al., "Cavitation: A technology on the horizon," *Current Science* 91 (No. 1): 35-46 (2006). The HSD of certain embodiments of the present system and methods may induce cavitation whereby one or more reactant is dissociated into free radicals, which then react. In embodiments, the extreme pressure at the tips of the rotors/stators leads to liquid phase reaction, and no cavitation is involved.

Various dimensions, sizes, quantities, volumes, rates, and other numerical parameters and numbers have been used for purposes of illustration and exemplification of the principles of the invention, and are not intended to limit the invention to the numerical parameters and numbers illustrated, described or otherwise stated herein. Likewise, unless specifically stated, the order of steps is not considered critical. The different teachings of the embodiments discussed herein may be employed separately or in any suitable combination to produce desired results.

While preferred embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, and so forth). Use of the term 'optionally' with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the preferred embodiments of the present invention. The disclosures of all patents, patent applications, and publications cited herein are hereby incorporated by reference, to the extent they provide exemplary, procedural or other details supplementary to those set forth herein.

What is claimed is:

1. A method of removing sulfur from sour oil, the method comprising:

(a) introducing reactants comprising at least one liquid phase desulfurizing agent, and sour oil having a first sulfur content into a high shear device, wherein the reactants are subjected to high shear, thus producing a high shear treated stream comprising elemental sulfur, ammonium sulfate, or both; wherein the at least one desulfurizing agent is selected from the group consisting of aqueous ammonia, ammonium sulfate, and combinations thereof, and wherein the sour oil comprises one or more sulfur-containing component selected from the group consisting of hydrogen sulfide, organic sulfides, organic disulfides, thiols, and thiophene sulfurs, which is converted to elemental sulfur via the high shear; and (b) separating a sulfur-rich product, a sweetened oil product, and a recycle desulfurizing agent stream from the high shear-treated stream, wherein the sulfur-rich product comprises at least a portion of the elemental sulfur, the ammonium sulfate, or both produced in (a), whereby the sulfur is separated directly from the sweetened oil as elemental sulfur, ammonium sulfate, or both, wherein the sweetened oil product has a second sulfur content that is less than the first sulfur content, and wherein the recycle desulfurizing agent stream comprises at least one recycle component selected from the group consisting of unreacted desulfurizing agent introduced in (a), ammonium sulfate produced in (a), and combinations thereof; and (c) recycling at least a portion of the recycle desulfurizing agent stream to (a).

2. The method of claim 1 wherein (a) subjecting the sour oil to high shear in the presence of the at least one desulfurizing agent comprises subjecting the slurry to a shear rate of at least 10,000 $s^{-1}$.

3. The method of claim 2 wherein (a) subjecting the sour oil to high shear in the presence of the at least one desulfurizing agent comprises subjecting the slurry to a shear rate of at least 20,000 $s^{-1}$.

4. The method of claim 1 wherein at least one desulfurizing agent is selected from the group consisting of aqueous ammonia, sodium hydroxide, potassium hydroxide, ammonium sulfate, calcium carbonate, hydrogen peroxide, monoethanolamine (MEA), diglycolamine (DGA), diethanolamine (DEA), diisopropanolamine (DIPA) and methyldiethanolamine (MDEA).

5. The method of claim 4 wherein at least one desulfurizing agent is selected from the group consisting of ammonium sulfate and aqueous ammonia.

6. The method of claim 1 wherein the sour oil and the at least one desulfurizing agent are provided in a ratio of about 50:50 volume percent.

7. The method of claim 1 wherein the first sulfur content is in the range of from about 0.5 to 6 weight percent.

8. The method of claim 7 wherein the second sulfur content is less than 50% of the first sulfur content.

9. The method of claim 7 wherein the second sulfur content is less than 10% of the first sulfur content.

10. The method of claim 1 wherein the second sulfur content is less than 0.5 weight percent.

11. The method of claim 1 wherein (a) subjecting sour oil to high shear comprises introducing the sour oil and the at least one desulfurizing agent into a high shear device comprising at least one rotor and at least one complementarily-shaped stator.

12. The method of claim 11 wherein high shear comprises a shear rate of at least 10,000 $s^{-1}$, wherein the shear rate is defined as the tip speed divided by the shear gap, and wherein the tip speed is defined as $\pi Dn$, where D is the diameter of the at least one rotor and n is the frequency of revolution.

13. The method of claim 12 wherein high shear comprises a shear rate of at least 20,000 $s^{-1}$, wherein the shear rate is defined as the tip speed divided by the shear gap, and wherein the tip speed is defined as $\pi Dn$, where D is the diameter of the at least one rotor and n is the frequency of revolution.

14. The method of claim 12 wherein subjecting the sour oil to a shear rate of at least 10,000 $s^{-1}$ produces a local pressure of at least about 1034.2 MPa (150,000 psi) at a tip of the at least one rotor.

15. The method of claim 11 wherein (a) comprises providing a tip speed of the at least one rotor of at least about 23 msec, wherein the tip speed is defined as $\pi Dn$, where D is the diameter of the at least one rotor and n is the frequency of revolution.

16. The method of claim 11 wherein the shear gap, which is the minimum distance between the at least one rotor and the at least one complementarily-shaped stator, is less than about 5 μm.

17. The method of claim 1 wherein (a) comprises subjecting sour oil to high shear in the presence of at least one API-adjustment gas, wherein the API adjustment gas comprises at least one compound selected from the group consisting of hydrogen, carbon monoxide, carbon dioxide, methane and ethane.

18. The method of claim 17 wherein the sour oil has a first API gravity and the sweetened oil product has a second API gravity, and wherein the second API gravity is greater than the first API gravity.

19. The method of claim 17 wherein the API-adjustment gas is selected from the group consisting of associated gas, unassociated gas, FCC offgas, coker offgas, pyrolysis gas, hydrodesulfurization offgas, catalytic cracker offgas, thermal cracker offgas, hydrogen, carbon monoxide, carbon dioxide, methane, ethane, and combinations thereof.

20. The method of claim 19 wherein the high shear-treated stream comprises API-adjustment gas bubbles having an average diameter of less than or equal to about 5, 4, 3, 2 or 1 μm.

21. The method of claim 20 wherein the API-adjustment gas bubbles have an average diameter of less than or equal to about 100 nm.

22. The method of claim 1 wherein the sour oil has a first API gravity and the sweetened oil has a second API gravity, and wherein the second API gravity is greater than the first API gravity.

23. The method of claim 1 further comprising extracting at least a portion of the sour oil from the earth at a well site at which the method is carried out.

24. The method of claim 1 wherein the sulfur-rich product is yellow.

25. The method of claim 1 wherein aqueous ammonia is utilized in (a), ammonium sulfate is produced in (a), separated in (b) and recycled in (c) to (a) as desulfurizing agent, and wherein aqueous ammonia is introduced in (a) only as needed to maintain a desired second sulfur content.

26. The method of claim 1 wherein the sour oil further comprises at least one impurity selected from the group consisting of heavy metals and chlorides.

27. The method of claim 26 wherein at least one of the at least one impurities is separated from the high shear-treated stream with the sulfur-rich product.

28. The method of claim 27 wherein the at least impurity is selected from vanadium, mercury, and chlorides.

29. The method of claim 1 wherein the sulfur-rich product is separated as a substantially dry product.

30. The method of claim 1 wherein (b) separating comprises centrifugation, filtration, or a combination thereof.

* * * * *